United States Patent [19]

Heikkinen

[11] Patent Number: 4,638,610

[45] Date of Patent: Jan. 27, 1987

[54] THEATRICAL STAGE

[75] Inventor: Urho Heikkinen, Helsinki 40, Finland

[73] Assignee: Elevator GmbH, Baar, Switzerland

[21] Appl. No.: 778,761

[22] Filed: Sep. 23, 1985

Related U.S. Application Data

[63] Continuation of Ser. No. 471,833, Mar. 3, 1983, abandoned.

[51] Int. Cl.[4] ..... E04H 12/18

[52] U.S. Cl. ..... 52/109; 52/7; 254/122; 254/126; 108/145; 108/147; 248/157

[58] Field of Search ..... 52/6, 7, 29, 109, 7; 108/145, 147; 248/421, 422, 157; 254/122, 126, 9 C

[56] References Cited

U.S. PATENT DOCUMENTS

| | | | |
|---|---|---|---|
| 2,747,692 | 5/1956 | Holmes | 254/122 |
| 2,829,928 | 4/1958 | Callaway | 254/9 C |
| 2,993,675 | 7/1961 | Tatter | 108/145 |
| 3,034,765 | 5/1962 | Ludowici | 154/122 |
| 3,404,494 | 10/1968 | Wolfe | 52/29 |
| 3,700,070 | 10/1972 | King | 52/109 |
| 3,812,631 | 5/1974 | Cruse | 52/7 X |
| 3,982,718 | 9/1976 | Folkenroth | 248/421 |
| 4,041,799 | 8/1977 | Teti | 254/122 |
| 4,232,901 | 11/1980 | Harrington | 108/147 |

*Primary Examiner*—John E. Murtagh
*Assistant Examiner*—Caroline D. Dennison
*Attorney, Agent, or Firm*—Martin Smolowitz

[57] ABSTRACT

A theatrical stage, comprising a plurality of side-by-side, screw-operated shearlegs tables, each such table having its own operating mechanism connected to the operating vertical screw. The screw is pivotally connected to the shearlegs members by dual transmission members, by which movement of the table platform is made almost linear in relation to the rotation of the screw. The vertical movement of the platform of the shearlegs tables is synchronized by employing as operating mechanism, electro-hydraulic step motors for each table, with a brake mounted on each screw for arresting rotary motion of the step motor.

5 Claims, 2 Drawing Figures

THEATRICAL STAGE

This application is a continuation of U.S. application Ser. No. 471,833 filed Mar. 3, 1983 and which has been abandoned.

SUMMARY OF INVENTION

The present invention concerns a theatrical stage comprising a plurality of side-by-side, screw-operated shearlegs tables, each such table having its own operating mechanism connected to the operating screw for controlling the vertical position of the table platform.

The theatrical stage of the invention is characterized in that the movement of the shearlegs tables has been synchronized by employing electro-hydraulic step motors for their operating mechanism. With the aid of the invention, the positions of the tables, both individually and with reference to each other, are always at correct elevation because a step motor used in connection with a mechanical screw causes no errors to the tables movement in vertical direction. The hydraulic step motor will not stop until it has turned the screw the required number of turns, whereby the table will positively remain stationary at the correct height. When it is desired to have all tables or part of them positioned on the same level, they will be positioned by the step motor at the same level with very high accuracy.

An advantageous embodiment of the invention, wherein there are shearlegs members between the table platform and the shearlegs base, by the aid of which members the platform is held in a constant direction in spite of its vertical movements and wherein the vertical movements of the platform have been accomplished by means of a screw connected with the shearlegs members, is characterized in that the screw has been connected to the shearlegs members by transmission members with the aid of which the movement of the platform will be throughout nearly linear in relation to the rotation of the screw. Hereby the platform lifting task can be managed with a less powerful lifting motor, because the required lifting force is the same in the upper as well as lower position of the platform movement. When the platform has been stopped at a given level, it is held firmly stationary because the screw has no elasticity, nor any leakage, like occurs for a hydraulic cylinder.

Another embodiment of the invention, featuring two shearlegs members located one over the other and pivotally joined, and each shearlegs member having its own pair of transmission member linkage arms, is characterized in that the lower end of the linkage arm pair of the upper shearlegs member has been pivotally attached at one common pivotal point of the shearlegs members, and that the upper end of the linkage arm pair of the lower shearlegs member has been pivotally attached at the other common pivotal point of the shearlegs members, and that one and the same screw acts on both linkage arm pairs. It thus becomes possible by one and the same screw to make the lifting movements act on both shearlegs members, whereby the forces are more uniformly distributed over the whole lifting system for a shearlegs table.

A third embodiment of the invention is characterized in that the step motors for the operating mechanism of the shearlegs tables are all electrically controllable from one and the same control desk.

Another embodiment of the invention is further characterized in that the screws of the tables have been arranged, on stopping of the screws' rotary motion, to be automatically arrestable by means of a brake mounted on the shaft of the screw. Thus the shearlegs table will remain firmly stationary when the rotary motion of the step motor has stopped.

BRIEF DESCRIPTION OF DRAWINGS

The invention is described in the following with the aid of an example, with reference made to the attached drawing, wherein.

DESCRIPTION OF INVENTION

Figure 1:
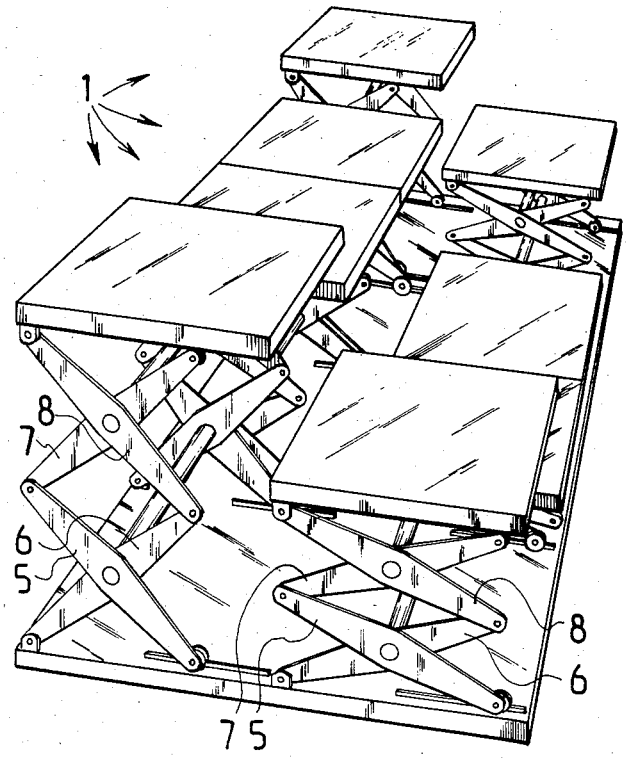
FIG. 1 presents part of a theatrical stage, simplified and viewed obliquely from above and including a plurality of side-by-side screw-operated shearlegs tables.
Figure 2:
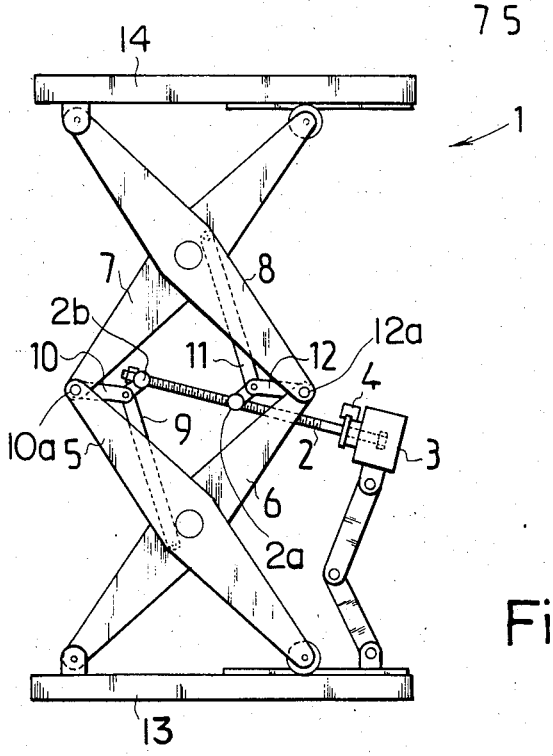
FIG. 2 presents a shearlegs table in elevational end view used in the stage according to the invention.

As is shown by FIGS. 1 and 2, the theatrical stage comprises a plurality of side-by-side, operating screw-operated shearlegs tables 1, each such table having its own operating mechanism 3 connected to the screw 2 and to base member 13. The movement of the shearlegs tables 1 has been synchronized, employing as operating mechanism 3 electro-hydraulic step motors. The step motor comprises an electrically driven pulse motor, operating by electrical pulses and controlling the rotary movements of a hydraulically driven operating motor in accordance with instructions given in advance. After the commands and control actions, it is always known at which elevation the table platform 14 is residing. The step motors are electrically controllable from one and the same control desk. The operating screws 2 of the tables 1 have been arranged, after stopping of the platform movement, to be automatically arrestable by means of a brake 4 mounted on the shaft of each screw 2.

The screw 2 acts on the linkage rods 5, 6, 7, 8 of the shearlegs table by the aid of the transmission members linkage arms 9, 10, 11, 12. As is clearly shown by FIG. 2, the lower end of the transmission member linkage arm pair 11, 12 of the upper shearlegs member has been pivotally attached at common pivotal point **12*a* of the shearlegs members linkage rods 6 and 8. Also, the upper end of the transmission member linkage arm pair 9, 10 of the lower shearlegs members has been pivotally attached at the other common pivotal point 10*a* of the shearlegs members linkage rods 5 and 7. The operating screw 2 is rotatively connected to linkage arm pair 11, 12 at pivot point 2*a* and also is rotatively connected to linkage arm pair 9, 10 at pivot point 2*b*, whereby the movement of the table platform will be linear throughout, in relation to the rotation of the screw 2. As a consequence also the simultaneous movements of a plurality of tables 1**, compared with each other, will be equal in amount at all times, and the overall impression gained of the vertical movement and transformation of the theatrical stage is smooth and controlled.

It is obvious to a person skilled in the art that different embodiments of the invention may vary within the scope of the claims stated below. For instance, this system may be further elaborated by techniques known in themselves in the art, e.g. by providing the control desk with a memory carrying records of the transformations in the theatrical stage required in theater programmes, whereby the transformations will be accomplished rapidly and without physical exertion.

I claim:

1. A theatrical stage, comprising: a plurality of side-by-side screw-operated shearlegs tables, each said table having a platform and a base member connected by shearlegs members located one above the other and each having its own operating mechanism connected to a screw located between the platform and the base member, wherein the vertical movements of the platform is accomplished by the screw being pivotally connected to the shearlegs members at their common pivot points by transmission members, each transmission member including a pair of linkage arms in which one linkage arm is pivotally connected to the screw and the other linkage arm is pivotally connected to the common pivot point of the shearlegs members by the aid of which the vertical movement of each platform is almost linear in relation to the rotation of each said screw, and wherein the vertical movements of each shearlegs table platform is synchronized by using for each said operating mechanism an electric-hydraulic step motor connected to the screw.

2. A theatrical stage according to claim 1, wherein said step motors are electrically controllable from one and the same control desk.

3. A theatrical stage according to claim 1, wherein the screw for each table is arranged after stopping of the screw rotary motion to be automatically arrestable by means of a brake mounted on the shaft of the screw.

4. A theatrical stage according to claim 2, wherein the control desk is provided with a memory means carrying records of vertical movements of the platforms for the tables.

5. A theatrical stage, comprising: a plurality of the side-by-side screw-operated shearlegs tables, each said table having a platform and a base member connected by shearlegs members located one above the other and each having its own operating mechanism connected to a screw located between the platform and the base members, said screw being connected to the shearlegs members of each said table at their common pivot points by a transmission member including a pair of linkage arms pivotally attached to the shearlegs members, each linkage arm pair being pivotally connected at a common pivot point to said screw, wherein the lower end of the linkage arm pair of the upper shear-legs member is pivotally attached at one common pivotal point of the shearlegs members and to said screw, and the upper end of the linkage arm pair of the lower shearlegs member is pivotally attached at the other common pivotal point of the shearlegs members and to said screw, so that the vertical movements of the platform is made almost linear in relation to the rotation of each said screw, and wherein the vertical movements of each said shearlegs table platform is synchronized by using an electro-hydraulic step motor for each said operating mechanism, and each said screw is atuomatically arrestable by a brake mounted on the screw.

* * * * *